US007207633B2

(12) United States Patent
Wittenberg et al.

(10) Patent No.: US 7,207,633 B2
(45) Date of Patent: Apr. 24, 2007

(54) SCALING ASSEMBLY

(75) Inventors: John Wittenberg, Owen Sound (CA); Paul Morneault, Barrie Sound (CA)

(73) Assignee: Astec Industries, Inc., Chattanooga, TN (US)

( * ) Notice: Subject to any disclaimer, the term of this patent is extended or adjusted under 35 U.S.C. 154(b) by 0 days.

(21) Appl. No.: 10/960,208

(22) Filed: Oct. 7, 2004

(65) Prior Publication Data

US 2005/0077777 A1 Apr. 14, 2005

Related U.S. Application Data

(60) Provisional application No. 60/510,531, filed on Oct. 14, 2003.

(51) Int. Cl.
*E21B 1/38* (2006.01)
*B25D 9/18* (2006.01)

(52) U.S. Cl. ..... 299/37.5; 299/69; 299/100; 173/133; 173/206

(58) Field of Classification Search ..... 299/34.04, 299/34.05, 34.07, 37.3, 37.4, 37.5, 69, 79.1, 299/100; 173/93, 93.7, 94, 100, 133, 128, 173/206, 210; 37/447
See application file for complete search history.

(56) References Cited

U.S. PATENT DOCUMENTS 3,145,488 A * 8/1964 French ..... 37/447
3,367,716 A * 2/1968 Bodine ..... 299/14
3,922,017 A 11/1975 Cobb
3,958,831 A * 5/1976 Nakashima et al. ..... 299/64
4,080,000 A 3/1978 Paurat
4,453,772 A 6/1984 Roussin
4,625,438 A * 12/1986 Mozer ..... 37/447
4,679,857 A 7/1987 Roussin et al.
4,799,823 A 1/1989 Williams
4,834,461 A * 5/1989 Fidler et al. ..... 299/37.5
4,852,664 A * 8/1989 Terada et al. ..... 173/206
4,858,701 A 8/1989 Weyer
4,906,049 A 3/1990 Anderson
4,930,584 A * 6/1990 Chaur Ching et al. ..... 173/200
4,984,850 A 1/1991 Jensen
5,002,136 A * 3/1991 Barthomeuf ..... 173/114
5,072,993 A 12/1991 Dickerson
5,094,017 A 3/1992 Matsumoto et al.
5,102,200 A 4/1992 Woody (Continued)

FOREIGN PATENT DOCUMENTS

WO 0578623 * 1/1994

*Primary Examiner*—Sunil Singh
(74) *Attorney, Agent, or Firm*—Chambliss, Bahner & Stophel, P.C.

(57) ABSTRACT

A scaling apparatus comprises a hammer component and a pick component which includes a tooth. The apparatus also includes a mechanism for moving the pick component with respect to the hammer component to thereby impart a scaling force to and through the tooth. In a preferred embodiment of the invention, the pick component includes a pick body comprising a first pivot having a pivot axis and a tooth mounted on the pick body. In this embodiment of the invention, the hammer component includes a hammer housing and a second pivot mounted within the housing and adapted to pivotally engage the first pivot of the pick body. This embodiment of the invention also includes a mechanism for rotating the pick body relative to the hammer component so as to impart a scaling force.

17 Claims, 13 Drawing Sheets

U.S. PATENT DOCUMENTS 5,407,252 A 4/1995 Perero
5,520,254 A * 5/1996 Weber ..... 173/128
6,234,718 B1 5/2001 Moffitt et al.
6,517,164 B1 2/2003 White
6,574,891 B1 * 6/2003 Ireland et al. ..... 37/447

* cited by examiner

SCALING ASSEMBLY

CROSS REFERENCE TO RELATED APPLICATION

This application claims the benefit of U.S. Provisional Application No. 60/510,531, which was filed on Oct. 14, 2003.

FIELD OF THE INVENTION

This invention relates generally to an apparatus for use in scaling operations in connection with underground mining, in which loose and fractured material may be removed from the roof and walls of the mine in a safe manner. The invention may also be used in removing slag and scale from inside ladles and other items of equipment used in metallurgical processes.

BACKGROUND AND DESCRIPTION OF THE PRIOR ART

In underground mining operations, an access tunnel is bored into or beneath the earth, and miners and their equipment are introduced to extract coal, limestone, precious metals and other minerals from product-bearing seams. Such mining operations may involve blasting into the face of a seam and/or the use of digging equipment to dig into the face. Such activities create instabilities in the walls of the mine, especially in the roof (also known as the "back"), as the equipment is advanced and the products of mining are removed, regardless of whether the mining is carried out by room-and-pillar methods, longwall methods or other methods. Such instabilities create a risk of roof falls and wall (or pillar) collapse, which may put the miners and their equipment in jeopardy.

Scaling is a process by which loose and fractured materials may be removed from the roof and walls of a mine as a part of the mining, cycle. Typically, scaling has been accomplished in several ways. The earliest known method, which is still practiced today, involves manually using a pry bar from the mine floor or from a scissor lift or manbasket boom to remove the loose material. This method is slow, inefficient, and can subject the scaling personnel to danger from falling materials. Another method involves the application of a stream of high-pressure water to the mine roof or walls; however, this method may not remove all fractured materials, and it presents the related problems of providing a supply of water and providing for its disposal.

Mechanical pick-type scaling machines are known by which machines employ a prying tool to which a static force is applied to remove material. Typically, these machines apply force to the prying tool by means of a hydraulic cylinder or actuator. These machines are typically much faster than manual scaling operations; however, the large forces applied by such machines may create additional stress cracks and other unstable conditions, which may lead to roof falls that damage or block the machines and mine personnel. In addition, mechanical pick-type scaling machines are more suited to use in layered rock formations such as limestone, and may not be efficient when used in other types of formations.

Conventional hydraulic breaker machines are also known for applying a series of hammer or impact blows to a tool in a generally downward direction to break rocks on a floor surface or to break up the floor surface itself. These machines operate by the application of a series of hammer blows to a tool, generally by the action of a reciprocating hydraulic actuator. Breaker-style scaling machines are known by which the hammer head of a hydraulic breaker machine is mounted on a boom so that the tool may be applied to a roof or wall surface for scaling purposes. Such breaker-style machines generally do not permit good visibility of the working surface by the operator, and they can also result in the application of too much energy to the rock, causing additional stress cracks (which require additional scaling) and falls. Furthermore, such breaker-style machines typically operate in such a manner as to apply forces to the boom in a direction that is not aligned with the axis of the boom. Consequently, such machines may create severe reaction forces in the knuckle joints of the boom, leading to excessive wear and vibration and a reduced service life.

It would be desirable, therefore, if a scaling device could be developed that would avoid some of the problems of known scaling systems.

ADVANTAGES OF THE INVENTION

Among the advantages of the invention is that it provides a scaling apparatus that may apply impact energy more efficiently than conventional methods and systems. Another advantage of the invention is that it provides a scaling apparatus that is faster than conventional scaling methods and systems. Still another advantage of a preferred embodiment of the invention is that it provides a scaling apparatus that permits good visibility of the working surface by the operator. Among other advantages of a preferred embodiment of the invention is that it provides a scaling apparatus that is lighter in weight than conventional hydraulic breakers used in scaling applications. A lighter-weight scaling apparatus may be attached to a smaller, lighter-weight carrier that may be more maneuverable in the confines of a mine. Furthermore, a smaller machine will generally be less costly to operate than a conventionally-sized breaker-style machine.

Additional advantages of the invention will become apparent from an examination of the drawings and the ensuing description.

SUMMARY OF THE INVENTION

The invention comprises a scaling apparatus comprising a hammer component and a pick component which includes a tooth. Means are also provided for moving the pick component with respect to the hammer component to thereby impart a scaling force to and through the tooth.

In a preferred embodiment of the invention, the pick component includes a pick body comprising a first pivot having a pivot axis and a tooth mounted on the pick body. In this embodiment of the invention, the hammer component includes a hammer housing and a second pivot mounted within the housing and adapted to pivotally engage the first pivot of the pick body. This embodiment of the invention also includes means for rotating the pick body relative to the hammer component so as to impart a scaling force.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
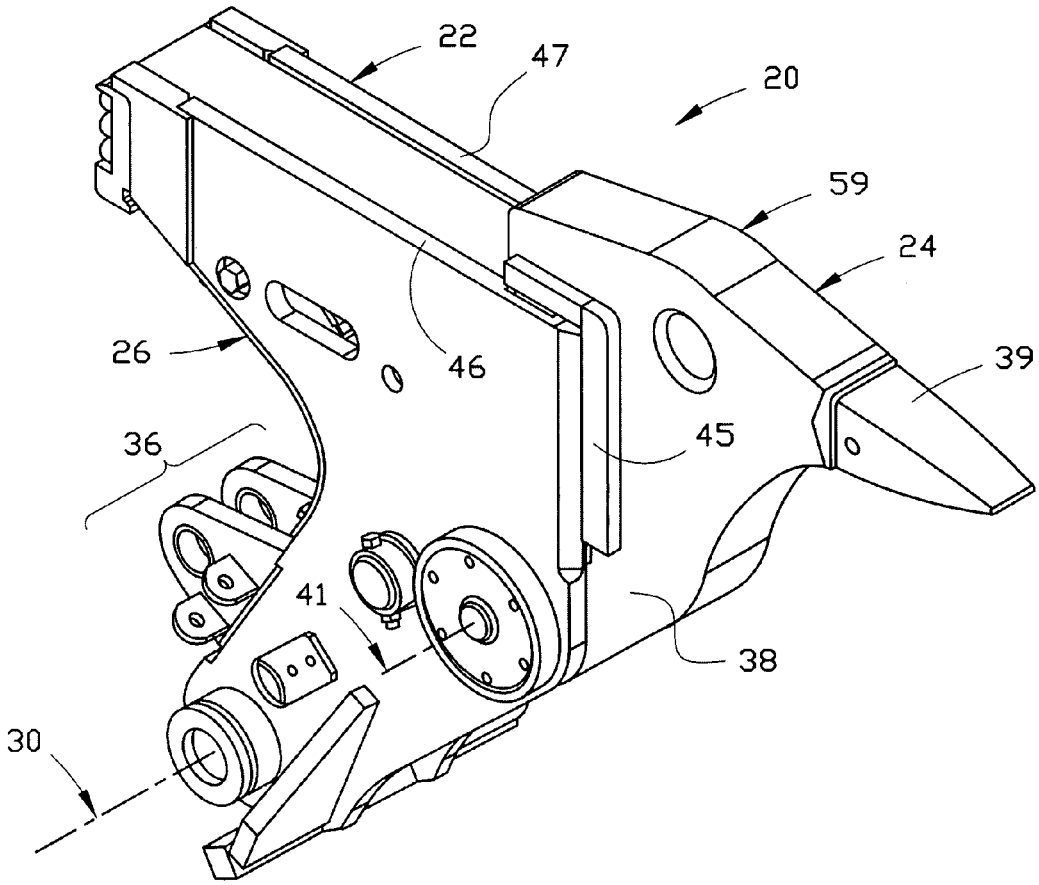
FIG. 1 is a perspective view of a preferred embodiment of the invention.
Figure 2:
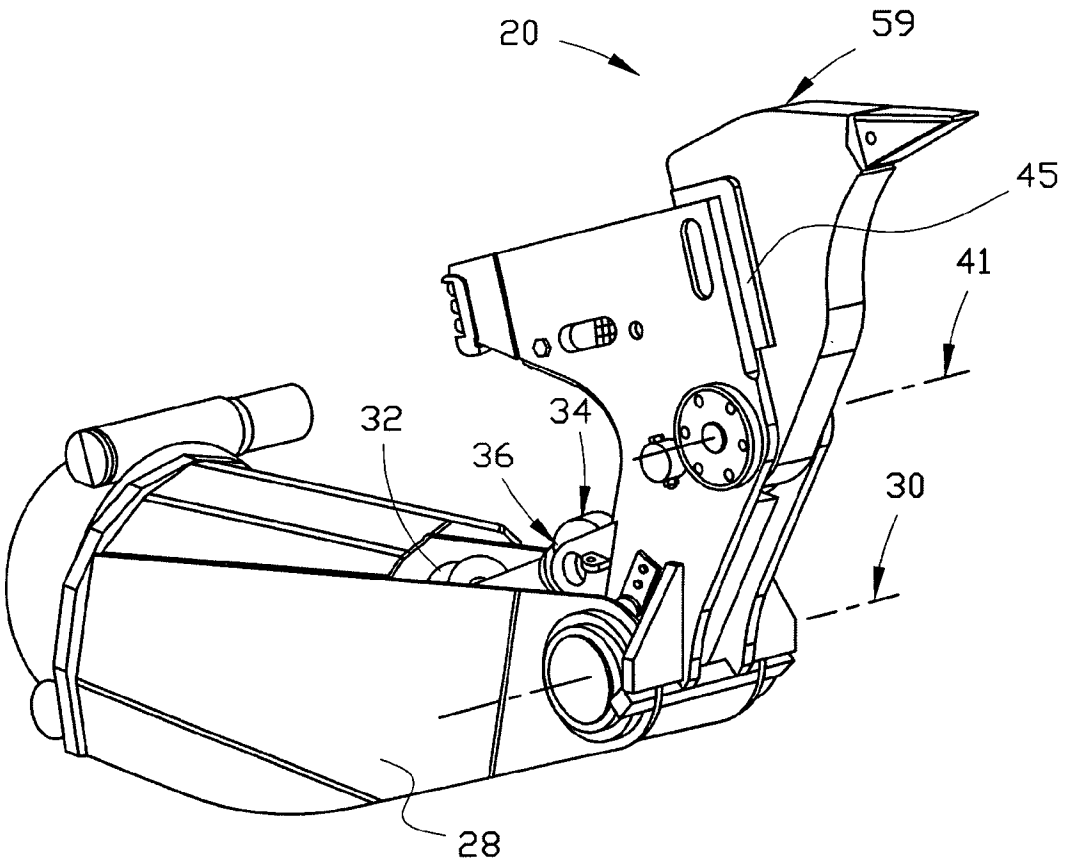
FIG. 2 is a perspective view of the preferred embodiment of FIG. 1, showing the scaling assembly of FIG. 1 mounted on a portion of a boom.
Figure 3:
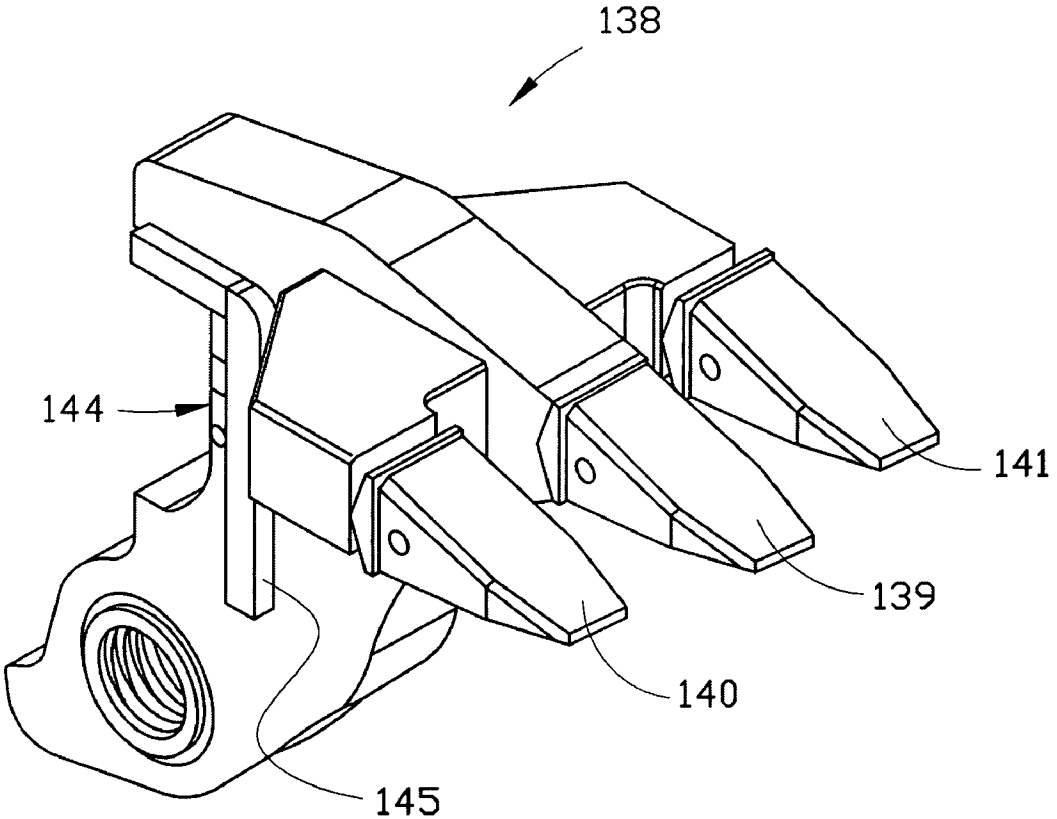
FIG. 3 is a perspective view of an alternative embodiment of the pick body of the scaling assembly.

Referring now to the drawings, a preferred embodiment of the invention, comprising scaling assembly 20, is shown in FIGS. 1, 2 and 5–7. Assembly 20 includes hammer component 22 and pick component 24. The hammer component includes hammer housing 26 that is preferably adapted to be pivotally attached to a boom such as boom 28 (a portion of which is shown in FIG. 2) so that it may be rotated about boom pivot axis 30. Preferably, scaling assembly 20 is rotatably positioned with respect to boom 28 by hydraulic actuator 32 (a portion of which is shown in FIG. 2) having rod end 34 that is pivotally attached to clevis 36 of assembly 20. Pick component 24 includes pick body 38 and tooth 39, which is mounted on the pick body. As shown in FIG. 3, an alternative embodiment of pick body 138 includes pick teeth (or ground engaging teeth) 139, 140 and 141. Other arrangements of teeth on the pick body as would be obvious to those having ordinary skill in the art to which the invention relates are also contemplated within the scope of this invention.

Figure 4:
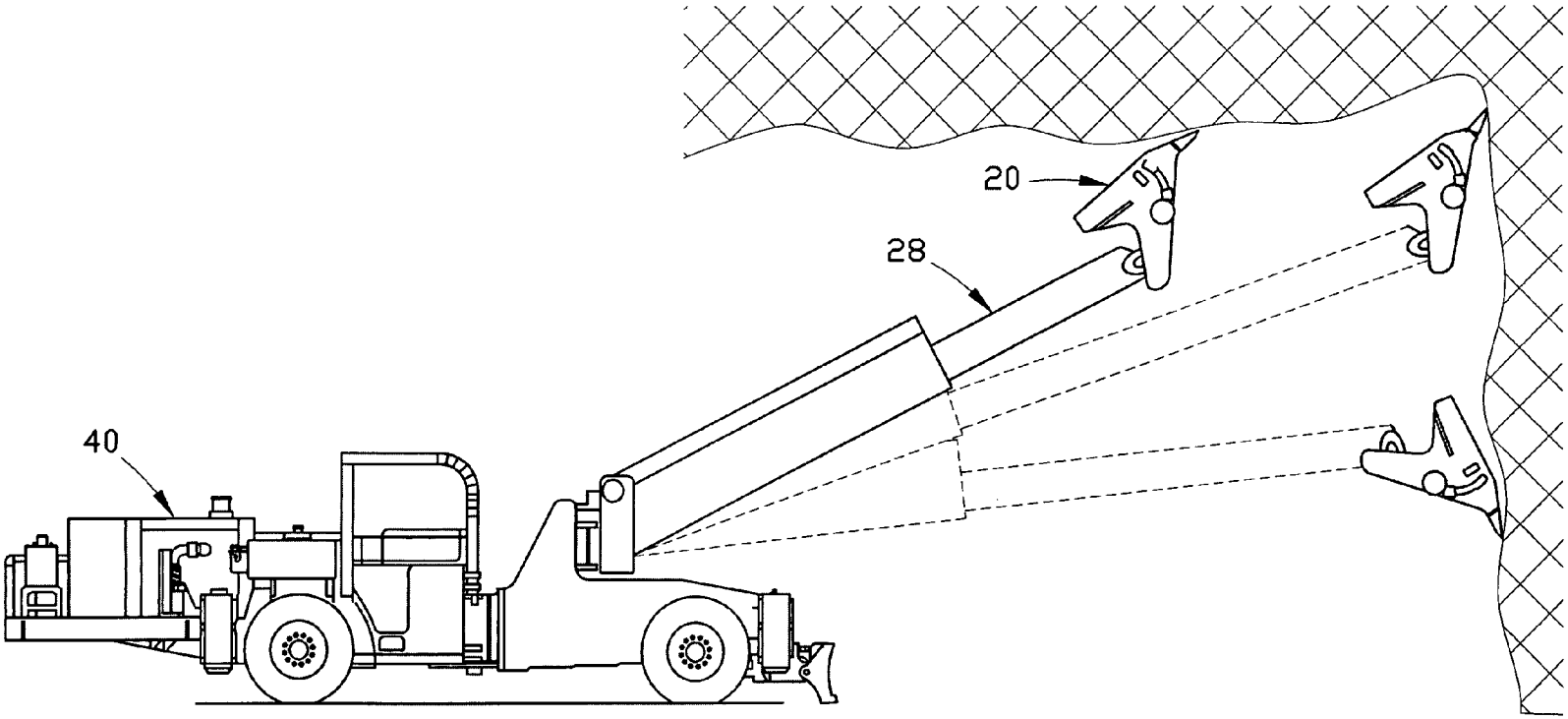
FIG. 4 is a side view of a vehicle on which the scaling assembly is mounted, showing its use in scaling the roof and wall of a mine.

Preferably, as shown in FIG. 4, scaling assembly 20 is mounted on boom 28, which in turn is mounted on a mobile carrier such as carrier 40. FIG. 4 shows three alternative configurations of the boom and scaling assembly to illustrate how the invention may be used in scaling the walls and roof of a mine.

Figure 5:
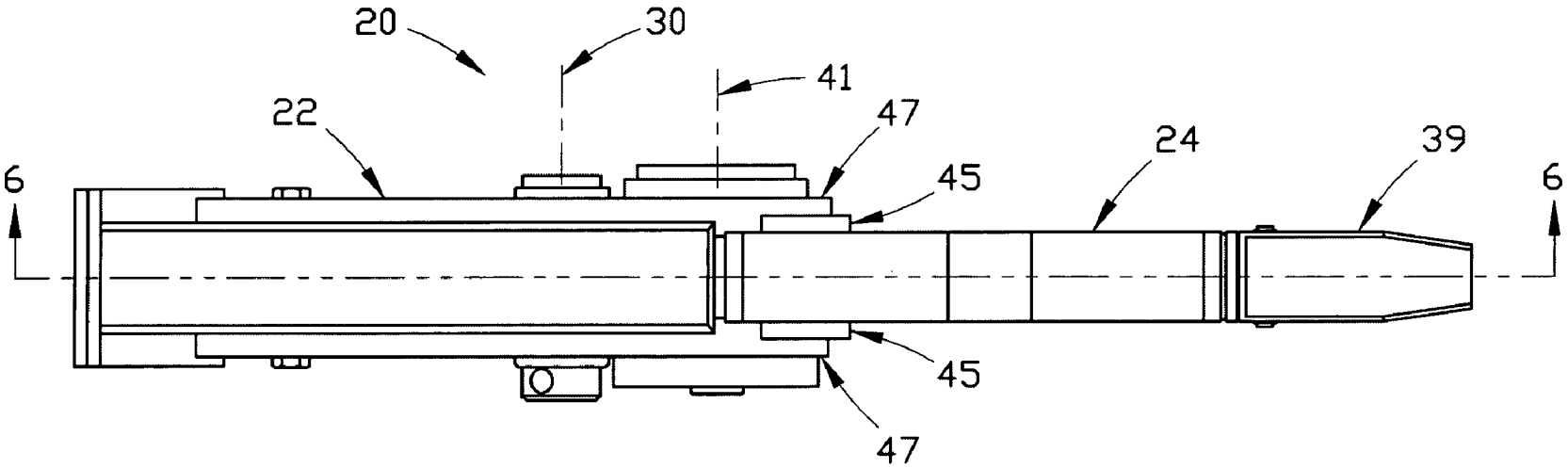
FIG. 5 is a top view of a the preferred embodiment of the invention shown in FIG. 1.
Figure 6:
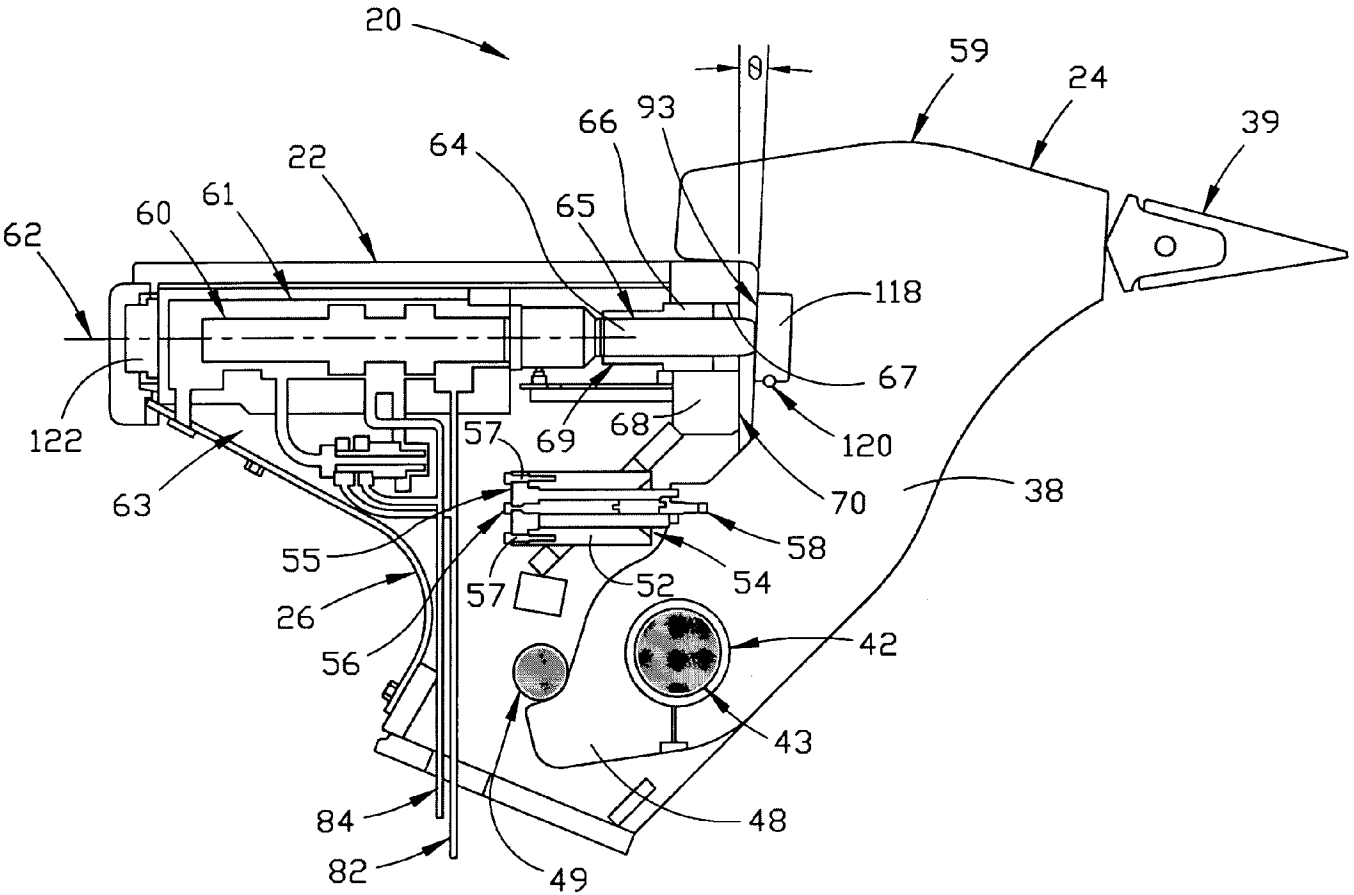
FIG. 6 is a sectional view of the embodiment of FIGS. 1 and 5, taken along line 6—6 of FIG. 5.

Preferred pick component 24 is pivotally attached to hammer component 22 so that it may be pivoted or rotated about pivot axis 41 between a start position and an impact position. As shown in FIGS. 5 and 6, pivot axis 41 is formed by the cooperation of a first pivot, such as pivot hole 42 of pick body 38, and a second pivot, such as pivot pin 43 of hammer housing 26. Preferably, a suitable bearing (not shown) is disposed between the pivot pin and the pivot hole. Of course, those having ordinary skill in the art to which the invention relates will appreciate that pivot hole 42 and pivot pin 43 could be replaced by a pivot hole in the hammer housing and a mating pivot pin on the pick body, although such embodiment is not shown in the drawings.

As shown by comparing FIG. 3 to FIGS. 1 and 5, a rear portion 144 of a preferred pick body is located behind the pick body side plates, one of which, side plate 145 of pick body 138, is shown in FIG. 3, or behind corresponding side plates 45 of pick body 38. The rear portion of the pick body will fit within a forward guidance groove in the hammer housing between side plates 46 and 47 of hammer housing 26. This will provide additional stability to the scaling apparatus and assist in minimizing the transmission of laterally-directed forces to the structures which form pivot axis 41, namely the first pivot of the pick body and the second pivot of the hammer housing.

In preferred embodiment 20, the rotation of pick body 38 with respect to hammer housing 26 is restrained by the interaction of tail piece 48 of pick body 38 and internal blocking bar 49 of hammer component 22 (shown in FIG. 6). It is also preferred that a biasing mechanism such as spring 52 be provided to urge the pick body and the hammer component apart. As shown in FIG. 6, spring 52 is retained in cavity 54 in hammer component 22 by spring guide 55 and fasteners 56 and 57, and it is attached to pick body 38 by fastener 58. The spring or other biasing mechanism is provided to urge the pick body into the position (relative to hammer component 22) shown in FIG. 6 so as to maximize the efficiency of the force application means of the hammer component, as discussed in more detail hereinafter. Preferably, the pick body is provided with an upper surface 59 which includes a rocker profile (best shown in FIGS. 2 and 6), which may assist in properly orienting the scaling apparatus with respect to the surface to which the scaling is to be applied.

Figure 7:
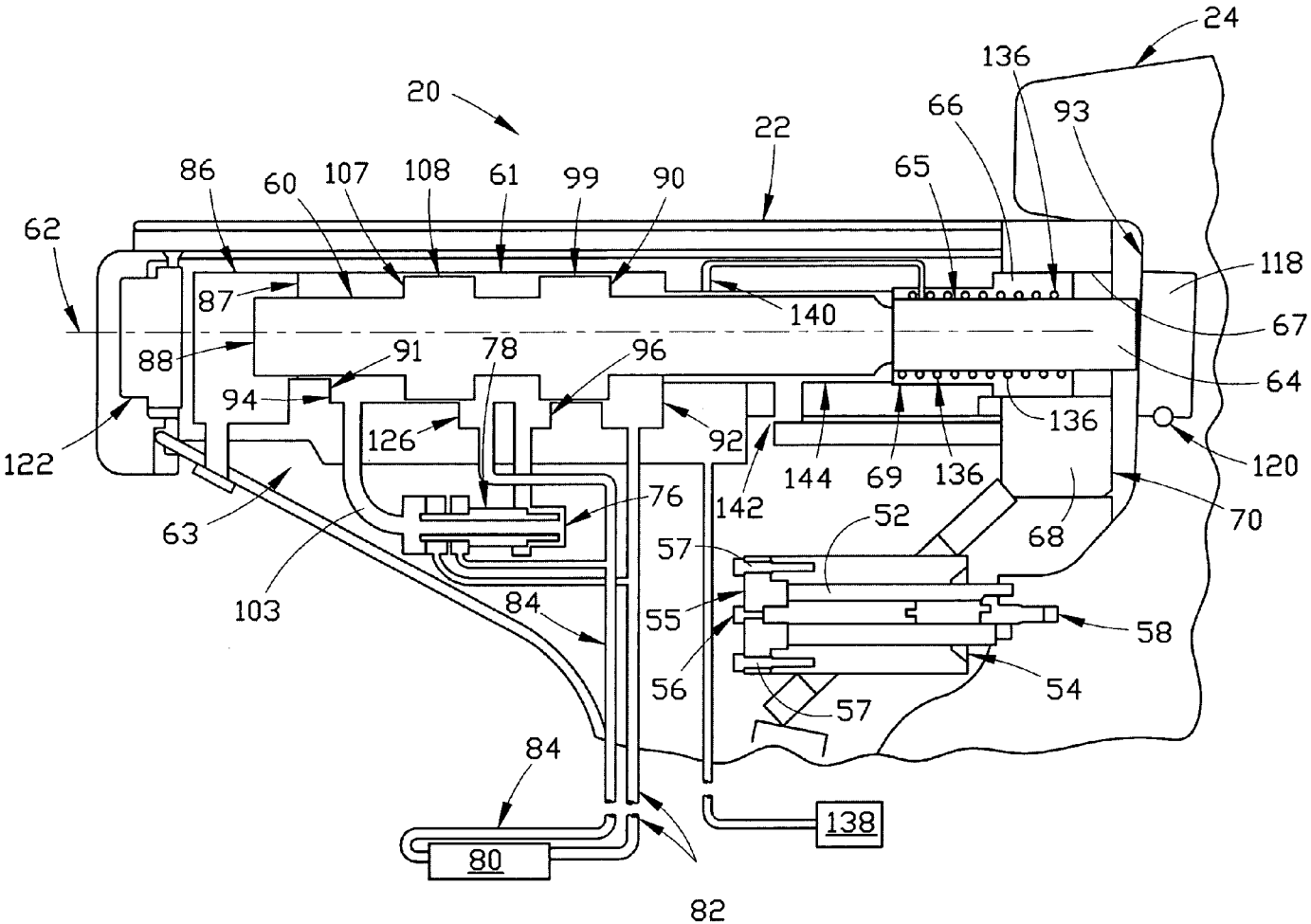
FIG. 7 is a detailed view of a portion of the sectional view of FIG. 6.

Referring now to FIGS. 6 and 7, preferred hammer component 22 includes hammer 60 which is disposed within generally cylindrical hammer channel 61 having a hammer channel axis 62. Scaling assembly 20 also includes means for applying force to the hammer so as to move it within the hammer channel along axis 62. This means for applying force to the hammer preferably comprises hydraulic system 63 (best illustrated schematically in FIGS. 8A–8E, but also shown in FIGS. 6 and 7), which is described in more detail hereinafter. Preferred hammer 60 acts as a force-applying mechanism and as a hydraulic piston within hammer channel 61. Hammer component 22 also includes tappet 64, which is disposed within tappet channel 65 that is defined in part by guide bushing 66. The tappet channel has a tappet channel axis which is preferably coincident with hammer channel axis 62, and the tappet is adapted to be moved along the tappet channel axis, preferably upon being struck by hammer 60. As best shown in FIGS. 6 and 7, guide bushing 66 is preferably mounted through a hole 67 in pick thrust plate 68 within a cylindrical cavity 69 in hammer housing 26. The forward face of the pick thrust plate preferably comprises forward face 70 of hammer component 22.

Figure 8A:
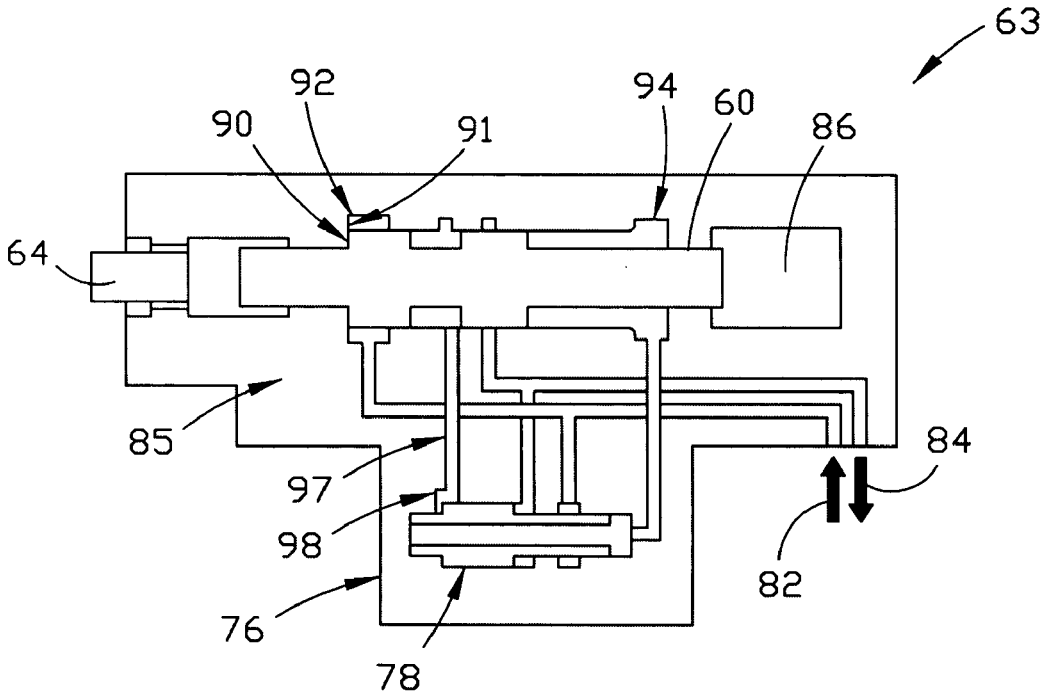
FIG. 8A is a schematic view of a portion of a preferred operating mechanism of the embodiments of the invention illustrated in FIGS. 1, 2 and 5–7, showing a first step in the operation of the scaling assembly.
Figure 8B:
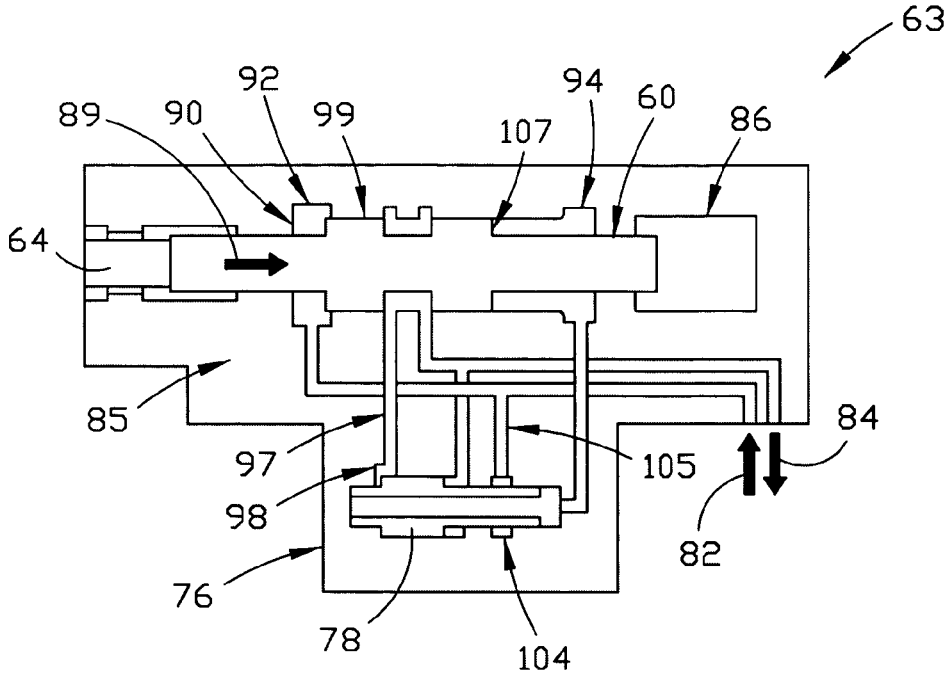
FIG. 8B is a schematic view of a portion of a preferred operating mechanism of the embodiments of the invention illustrated in FIGS. 1, 2 and 5–7, showing a second step in the operation of the scaling assembly as pressure is applied against the pick body of the invention.
Figure 8C:
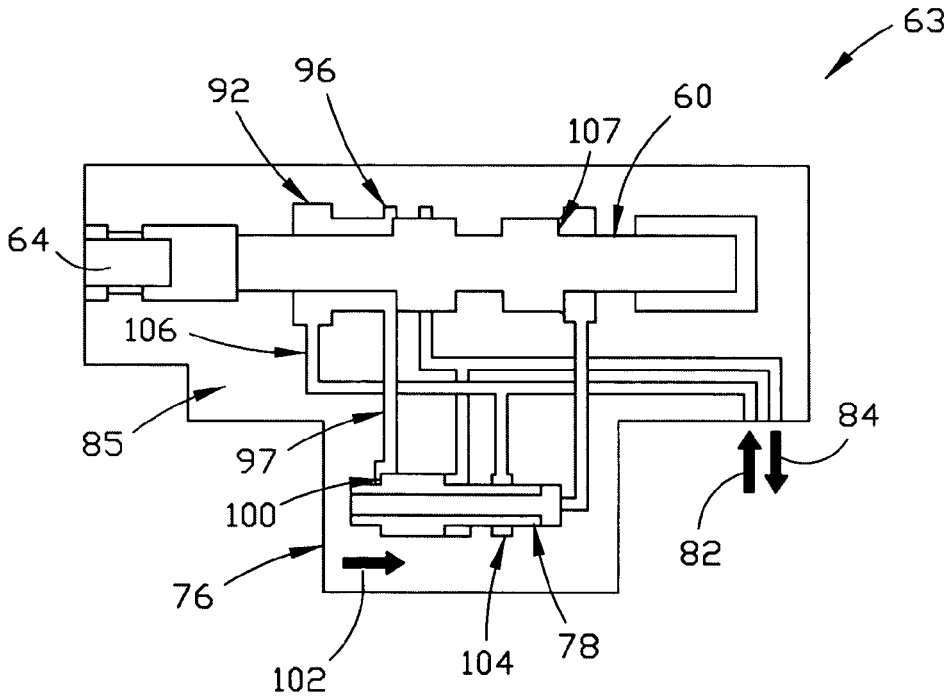
FIG. 8C is a schematic view of a portion of a preferred operating mechanism of the embodiments of the invention illustrated in FIGS. 1, 2 and 5–7, showing a third step in the operation of the scaling assembly.
Figure 8D:
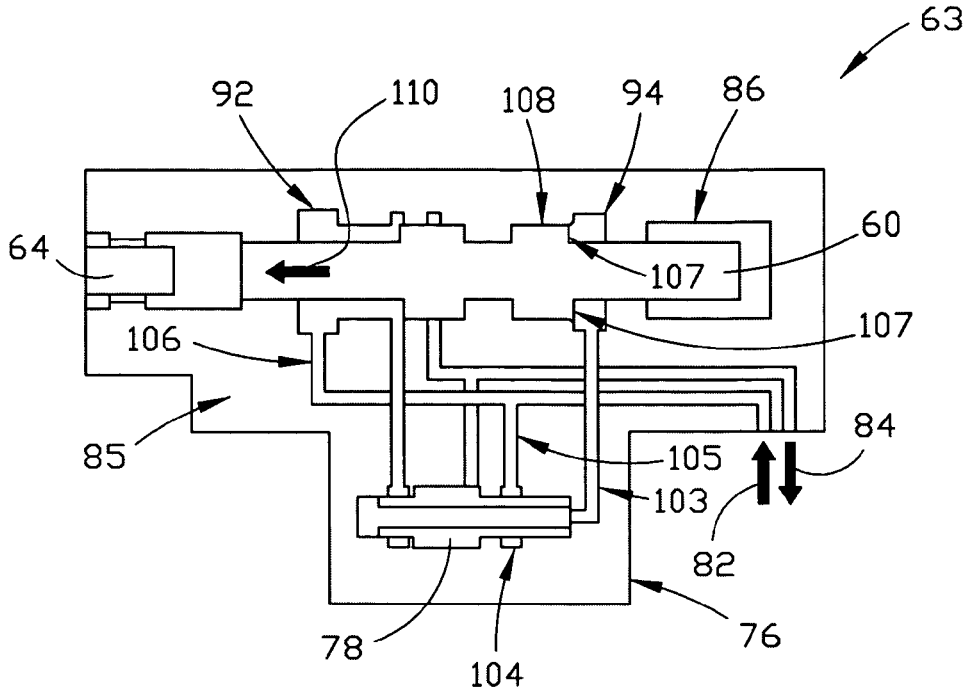
FIG. 8D is a schematic view of a portion of a preferred operating mechanism of the embodiments of the invention illustrated in FIGS. 1, 2 and 5–7, showing a fourth step in the operation of the scaling assembly.
Figure 8E:
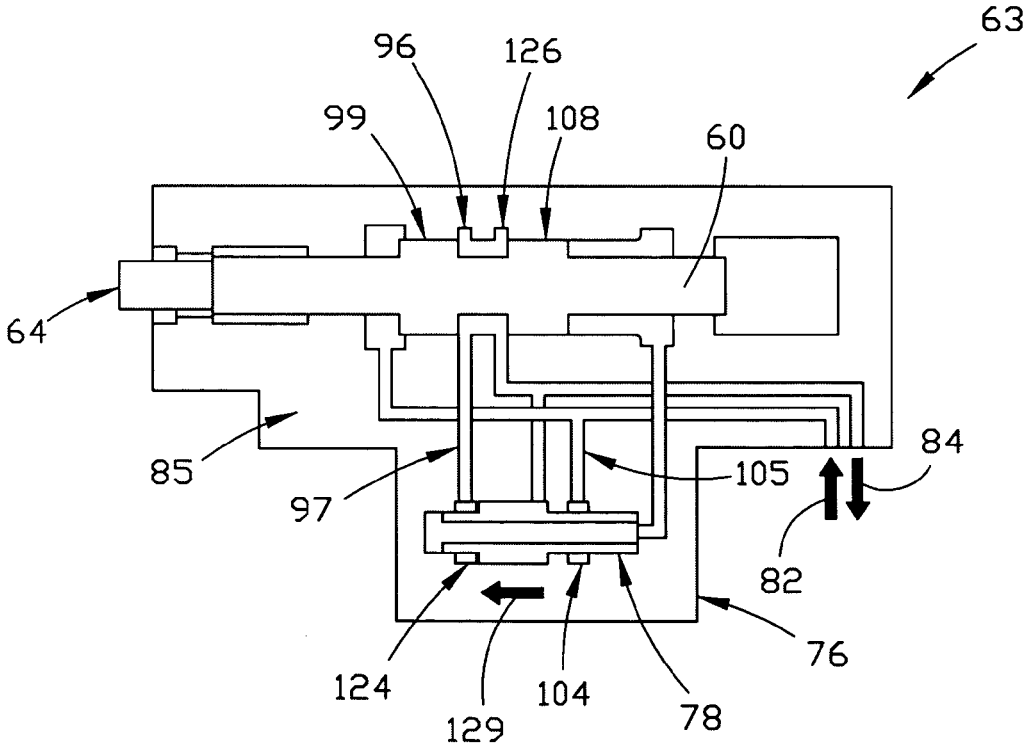
FIG. 8E is a schematic view of a portion of a preferred operating mechanism of the embodiments of the invention illustrated in FIGS. 1, 2 and 5–7, showing a fifth step in the operation of the scaling assembly.

Preferably, the means for applying force to the hammer moves the hammer from a first position, such as is illustrated in FIG. 8C or 8D, to a second position, such as is illustrated in FIG. 8E. Movement of preferred hammer 60 in this manner will cause tappet 64 to move from a first position, such as is illustrated in FIGS. 8B, 8C or 8D, to a second position, such as is illustrated in FIG. 8E, upon being struck by hammer 60. As shown in FIGS. 8A–8E, preferred hydraulic system 63 includes control valve 76 which includes spool 78. Control valve 76 is in fluid communication with hydraulic pump 80 (shown schematically in FIG. 7), hydraulic pressure line 82, hydraulic return line 84 and hydraulic circuit 85. Hydraulic pump 80 is preferably mounted on a carrier such as carrier 40 (shown in FIG. 4).

As shown in FIG. 8A, cushion chamber 86 is provided behind the hammer channel and is preferably isolated from the hydraulic circuit by bulkhead 87 (FIG. 7). Cushion chamber 86 is preferably charged with an inert gas such as nitrogen so as to exert a force on end 88 of hammer 60 in a direction opposite to that of arrow 89 (FIG. 8B). When preferred scaling assembly 20 is at rest, pressure from cushion chamber 86 pushes hammer 60 forward until hammer piston face 90 contacts chamber piston face 91 (FIG. 8A). Under these circumstances, tappet 64 will generally slide freely within tappet channel 65, and may slide so that its outer end extends out of hammer component housing 26, as shown in FIG. 8A. However, when hammer piston face 90 is in contact with chamber piston face 91, the flow of hydraulic fluid from hydraulic pressure line 82 into chamber 92 is shut off, and the scaling assembly will not cycle through the positions shown in FIGS. 8B–8E.

Referring now to FIG. 8B, when the tooth of the pick component is placed into contact with a surface to which a scaling force is to be applied, the resistance of the surface against the tooth is transmitted through the pick component to cause tappet 64 to push back against hammer 60 and against the resistance of biasing mechanism 52. This will rotate pick body 38 against the bias of the biasing mechanism to a start position (shown in FIG. 1) in which forward face 70 of hammer component 22 is closely aligned with impact surface 93 of pick component 24 so that the angle θ of rotation between the two components is approximately zero (see FIG. 6).

This movement of hammer 60 in the direction of arrow 89 will cause hydraulic fluid to flow into chamber 92, causing the fluid pressure in chamber 92 to be greater than that in chamber 94. This condition will create a force to further push the hammer in the direction of arrow 89, until the hammer has moved to the position illustrated by FIG. 8C where chamber 96 is in fluid communication with hydraulic line 97 and control valve chamber 98 (see FIG. 8B). Under these circumstances, the hydraulic force on hammer piston face 90 of piston component 99 of hammer 60 (caused by the higher fluid pressure in chamber 92 than in chamber 94) is more than enough to overcome the gas pressure on end 88 of hammer 60 in cushion chamber 86, so that the net force on hammer 60 moves it in the direction of arrow 89 to the position illustrated in FIG. 8C. When the hammer reaches this position, hydraulic fluid flows from chamber 96 through line 97 into control valve chamber 98, thereby raising the fluid pressure exerted on piston face 100 of control spool 78 so as to push the spool in the direction indicated by arrow 102.

When control valve spool 78 has moved in the direction of arrow 102 from the position shown in FIG. 8C to that shown in FIG. 8D, hydraulic fluid will move through line 103 to rear chamber 94 and from control spool chamber 104 through lines 105 and 106 to front chamber 92. Under these circumstances, there will be equal fluid pressure in chambers 92 and 94. However, because hammer piston face 107 of piston component 108 has a slightly greater surface area than hammer piston face 90 of piston component 99, (although such difference in surface areas is not apparent from an examination of the drawings), the cumulative effect of the net force of the hydraulic pressure on hammer piston face 107 and the force applied by cushion chamber 86 on piston end 88 will cause hammer 60 to move in the direction of arrow 110 from the first position shown in FIG. 8D to the second position shown in FIGS. 6, 7 and 8E, whereupon the hammer will impact tappet 64, causing it to move from the first position shown in FIG. 8D to the second position shown in FIGS. 6, 7 and 8E. This causes the tappet to strike impact surface 93 of the pick body, preferably on striker plate 118, which is preferably removably held in place in the pick body by retaining pin 120. When the tappet strikes the impact surface of the pick body, the pick body will pivot on pivot axis 41 by the angle θ (shown in FIG. 6) from its start position (shown in FIG. 1) to its impact position (shown in FIG. 6), thereby imparting a scaling force through tooth 39. Preferably, the angle θ will be no more than about 5°, and most preferably about 2.5°. Recoil pad 122 is preferably mounted behind cushion chamber 86 in order to absorb recoil (along with cushion chamber 86) from the force of a blow applied by the hammer component to the pick body.

Referring now to FIG. 8E, it can be seen that when the hammer hits the tappet, the portion of the hammer between piston component 99 and piston component 108 will come into contact with intermediate chambers 96 and 126. As a result, chamber 124 of the control valve will relieve fluid pressure through chambers 96 and 126. This will reduce the fluid pressure in chamber 124 below that of chamber 104, thereby causing the spool to move in the direction of arrow 129. This resets the control valve in the position of FIG. 8A, whereupon the application of a scaling force can be repeated.

Figure 9:
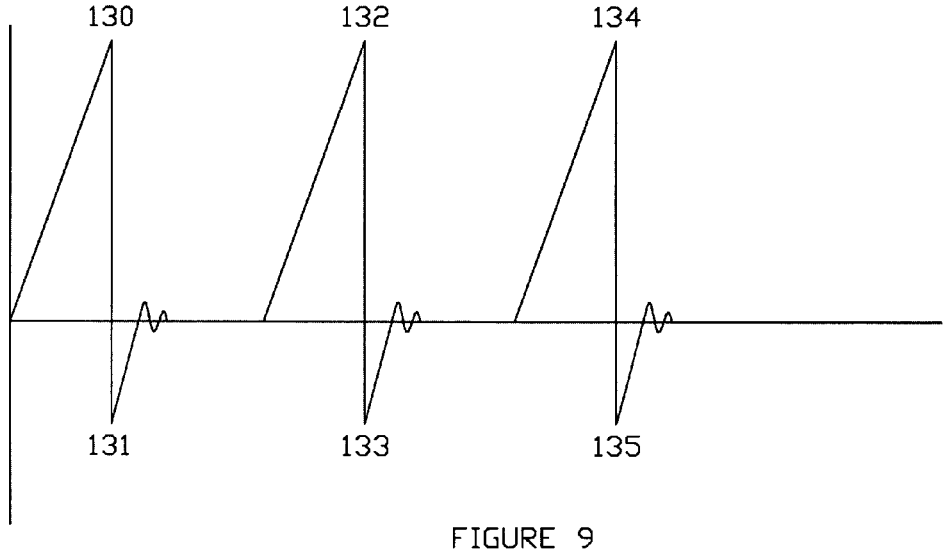
FIG. 9 is a graph of the energy wave of the preferred operating mechanism of the invention illustrated in FIGS. 1, 2 and 5–8E.

FIG. 9 illustrates the energy wave of the preferred operating mechanism of the embodiment of the invention illustrated in FIGS. 1, 2 and 5–8E. The X-axis represents time and the Y-axis represents the magnitude of the force applied. Points 130, 132 and 134 represent the magnitude of the impact force applied when the hammer strikes the tappet in three successive applications. Points 131, 133 and 135 represent the magnitude of the recoil force in these three successive applications, as the hammer recoils into the cushion chamber. An examination of FIG. 9 shows that the force applied between each of the successive hammer blows quickly diminishes to essentially zero.

Referring again to FIG. 7, scaling apparatus 20 is preferably provided with a lubrication system to lubricate the passage of tappet 64 in the tappet channel. In this preferred embodiment, guide bushing 66 is provided with a helical lubricant groove 136 which is in fluid communication with a lubricant pump such as pump 138 by means of lubricant fluid line 140. Preferably, pump 138 is mounted on a carrier such as carrier 40 (FIG. 4). The lubrication system also includes lubricant discharge vent 142 and lubricant discharge passage 144, which is in fluid communication with the lubricant groove and with vent 142.

Figure 10:
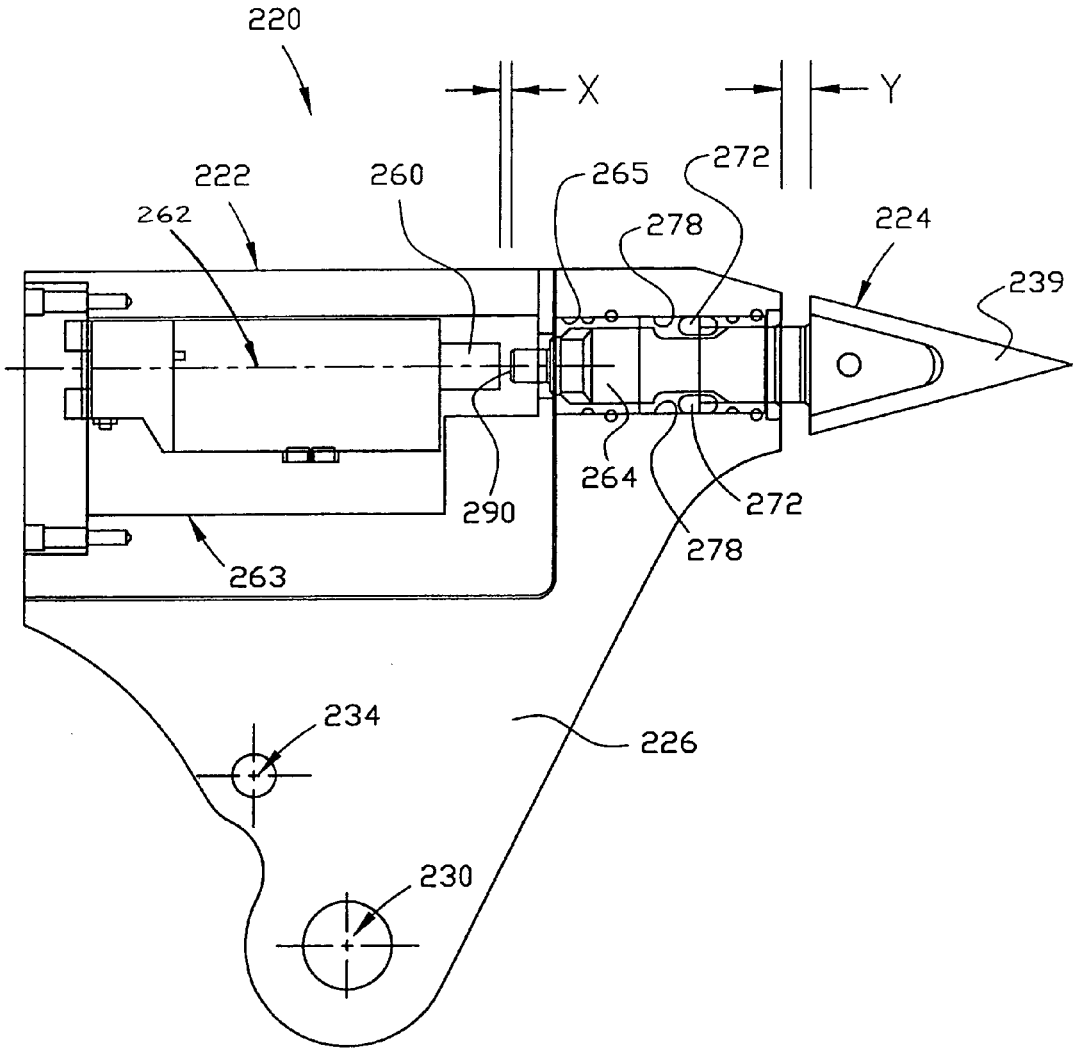
FIG. 10 is a sectional view, partially in schematic, of a first alternative embodiment of the invention.

Another embodiment of the invention is illustrated in FIG. 10. As shown therein, scaling assembly 220 includes hammer component 222 and pick component 224. The hammer component is preferably adapted to be pivotally attached to a boom and carrier (not shown) such as boom 28 (shown in FIGS. 2 and 4) and carrier 40 (shown in FIG. 4), so that it may be rotated about pivot axis 230. Preferably, scaling assembly 220 is rotatably positioned with respect to a boom by a hydraulic actuator (not shown) having a rod end that is pivotally attached at pivot axis 234 of scaling assembly 220.

Hammer component 222 of assembly 220 preferably includes hammer housing 226 and hammer 260 (part of which is shown in FIG. 10) which is disposed within a hammer channel (not shown in FIG. 10, but similar to hammer channel 61 of assembly 20) having a hammer channel axis 262. Pick component 224 also includes tooth 239 and tappet 264, which is disposed within tappet channel 265. The tappet channel has a tappet channel axis which is preferably coincident with hammer channel axis 262, and the tappet is adapted to be moved along the tappet channel axis, preferably upon being struck by hammer 260. Scaling assembly 220 also includes means for applying force to the hammer so as to move it within the hammer channel along axis 262. This means for applying force to the hammer preferably comprises hydraulic system 263 (shown schematically in FIG. 10, but similar to hydraulic system 63 of scaling assembly 20). Preferably, the means for applying force to the hammer moves the hammer from a first position (similar to that illustrated in FIG. 8B with respect to scaling apparatus 20) to a second position (similar to that illustrated in FIG. 8E with respect to scaling apparatus 20). Movement of hammer 260 in this manner will cause tappet 264 to move from a first position, (similar to that illustrated in FIG. 8B with respect to scaling apparatus 20) to a second position, (similar to that illustrated in FIG. 8E with respect to scaling apparatus 20) upon being struck by hammer 260. Pins 272 are preferably provided in slots 278 in tappet channel 265 to limit the distance that tappet 264 can be moved under the influence of a blow struck by hammer 260 onto end 280 of tappet 264-. As shown in FIG. 9, the distance traveled by hammer 260 is distance X, and the distance traveled by tappet 264 under the influence of a blow from the hammer is distance Y. Preferably, distance Y is about three times distance X.

Preferably, hammer component 222 includes a recoil pad (not shown) which is similar in structure and operation to recoil pad 122 of scaling apparatus 20. This recoil pad is preferably mounted behind a cushion chamber (not shown but similar to cushion chamber 86 of apparatus 20) in order to absorb recoil, along with the cushion chamber, from a blow of the hammer.

Figure 13:
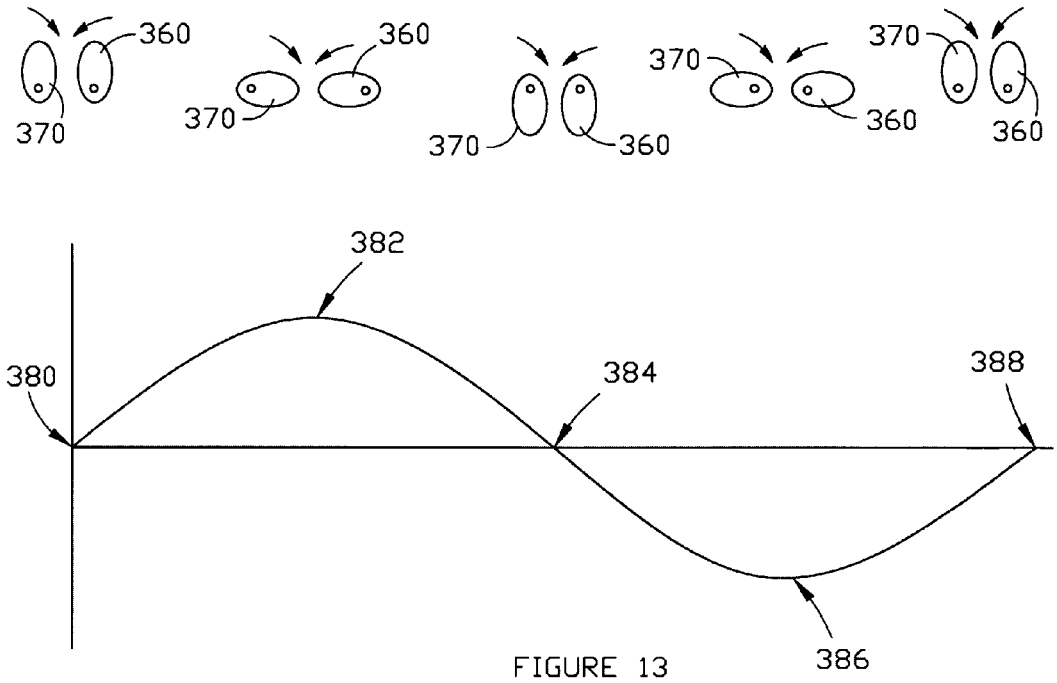
FIG. 13 is a graph of the energy wave of the operating mechanism of the embodiment of the invention illustrated in FIG. 11.
Figure 11:
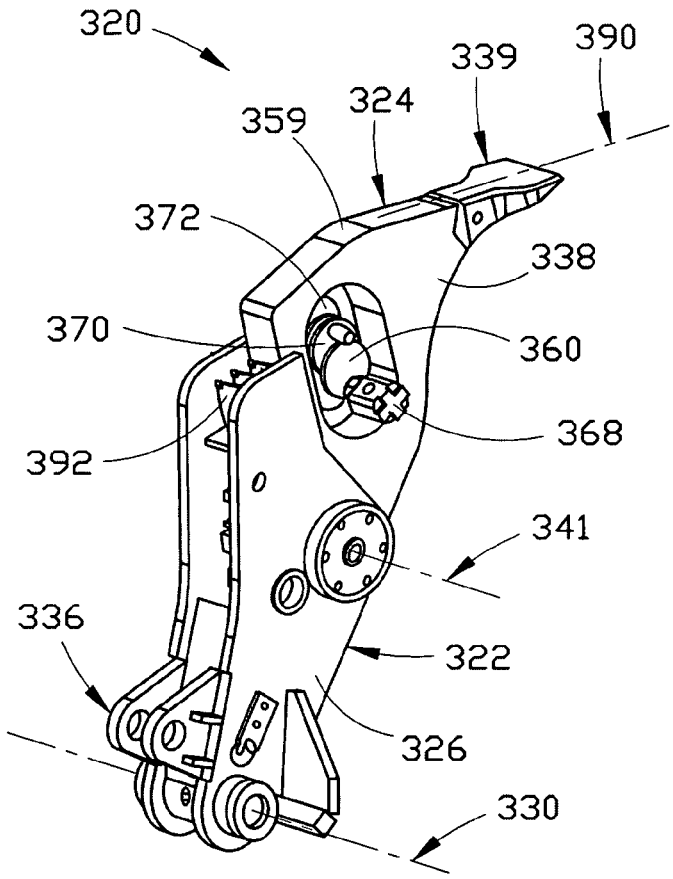
FIG. 11 is a perspective view of a portion of a second alternative embodiment of the invention.
Figure 12:
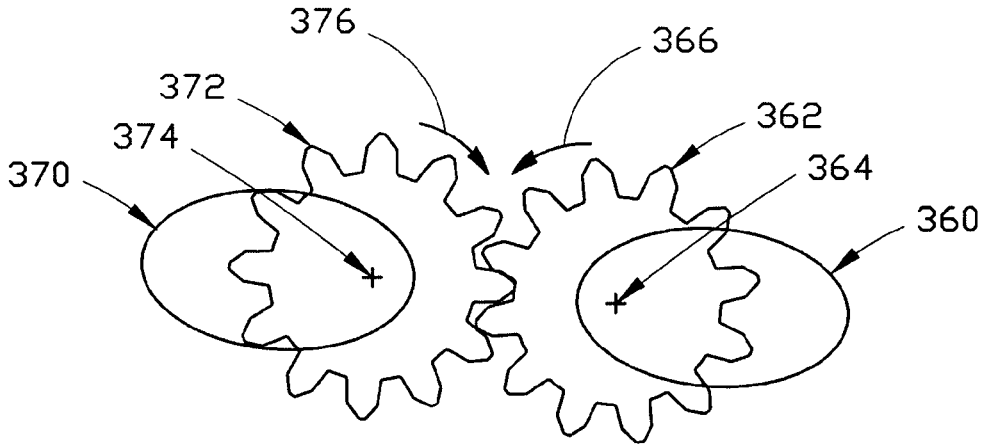
FIG. 12 is a schematic view of a portion of the means for rotating the pick body relative to the hammer component of the embodiment of the invention illustrated in FIG. 11.

Another embodiment of the invention is illustrated in FIGS. 11–13. As shown therein, scaling assembly 320 includes hammer component 322 and pick component 324. The hammer component includes hammer housing 326 that is preferably adapted to be pivotally attached to a boom such as boom 28 (FIG. 4) so that it may be rotated about boom pivot axis 330. Preferably, scaling assembly 320 is rotatably positioned with respect to a boom by a hydraulic actuator (not shown, but similar to actuator 32 of FIG. 2) having a rod end that is pivotally attached to clevis 336 of assembly 320. Pick component 324 includes pick body 338 and tooth 339, which is mounted on the pick body. Pick component 324 is pivotally attached to hammer component 322 so that it may be pivoted or rotated about pivot axis 341. It is preferred that the rotation of pick body 338 with respect to hammer housing 326 is restrained in a manner similar to that employed with respect to scaling apparatus 20. It is also preferred that a biasing mechanism (not shown, but similar to spring 52 of apparatus 20) be provided to urge the pick body and the hammer component apart. Preferably, pick body 338 is provided with an upper surface 359 which includes a rocker profile, so as to assist in properly orienting the scaling apparatus with respect to the surface to which the scaling is to be applied.

The preferred means or mechanism by which pick component 338 is rotated with respect to hammer component 322 comprises a pair of counter-rotating eccentric plates (illustrated schematically in FIG. 12). As shown in FIGS. 11 and 12, first eccentric plate 360 is mounted onto drive gear 362 so as to rotate about drive gear axis 364 in a first direction indicated by arrow 366. The drive gear is driven by motor 368, which is preferably a hydraulic motor. Second eccentric plate 370 is mounted onto idler gear 372 so as to rotate about idler gear axis 374 in a second or opposite direction indicated by arrow 376. As shown in the drawings, the eccentric plates of this embodiment of the invention are mounted on their respective gears so that they rotate in different planes and therefore do not interfere with each other.

FIG. 13 illustrates the energy wave of the preferred operating mechanism of the embodiment of the invention illustrated in FIGS. 11 and 12 for a single rotation of eccentric plates 360 and 370. The X-axis represents time and the Y-axis represents the magnitude of the force applied. As shown therein, the magnitude of the force applied follows a sinusoidal track, with the individual forces from each rotating eccentric plate reinforcing each other in both the direction of force application (to the right along axis 390 of FIG. 11) and in the recoil direction (to the left along axis 390) and canceling each other out in positions between the maximum application of force and maximum recoil. The forces applied in both directions are co-linear with axis 390 of FIG. 11, and as shown in FIG. 13, the net force rises from essentially zero at point 380 (corresponding to the orientation of the eccentric plates shown immediately above point 380) and reaches its peak at point 382 (when the eccentric plates are aligned as shown immediately above point 382). The magnitude of the net force applied falls back to essentially zero at point 384 (corresponding to the orientation of the eccentric plates shown immediately above point 384) and reaches its peak recoil force at point 386 (corresponding to the orientation of the eccentric plates shown immediately above point 386). The magnitude of the force applied again reaches essentially zero at point 388 (corresponding to the orientation of the eccentric plates shown immediately above point 388). Referring again to FIG. 11, a vibration isolator, or preferably, a plurality of elastomeric isolators 392 are preferably mounted behind pick component 324 in order to absorb some of the recoil force.

It should be appreciated that other arrangements of rotating eccentric plates (including, but not limited to a single rotating eccentric) may be employed to apply a force to rotate the pick component relative to the hammer component so as to apply a scaling force.

An advantage of the embodiments of the invention illustrated in the drawings is that the forces applied to the pick component are generally completely aligned (in both force application and recoil directions) with the axis of the boom to which the scaling assembly is attached.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations as would be understood by those having ordinary skill in the art to which the invention relates, and the same are intended to be comprehended within the meaning and range of equivalents of the appended claims.

What is claimed is:

1. A scaling apparatus comprising:

(a) a hammer component which includes;

(i) a hammer housing;

(ii) a hammer that is mounted so as to move within the hammer housing;

(b) a pick component which includes:

(i) a pick body that is pivotally mounted to the hammer component so as to be rotatable about a pivot axis;

(ii) a tooth mounted on the pick body;

(c) a biasing mechanism for applying a biasing force between the hammer component and the pick body so as to urge the pick body away from the hammer component;

(d) means for applying a force to the hammer to cause the pick component to rotate relative to the hammer component to apply a force through the tooth;

(e) control means for activating the means for applying force to the hammer only when an external force is applied to the pick body in opposition to the biasing force.

2. The scaling apparatus of claim 1 which includes:

(a) a boom on which the hammer housing is mounted;

(b) means for manipulating the boom.

3. The scaling apparatus of claim 1 wherein the hammer housing includes a vibration isolator that is adapted to cushion the impact of the pick body on the hammer component during recoil.

4. A scaling apparatus comprising:

(a) a hammer component which includes:

(i) a hammer housing having a hammer channel, said hammer channel having a hammer channel axis;

(ii) a hammer that is disposed within the hammer channel and adapted to be moved therein along the hammer channel axis;

(iii) means for applying force to the hammer so as to move the hammer along the hammer channel axis;

(b) a tappet channel having a tappet channel axis;

(c) a tappet which is disposed within the tappet channel and adapted to be moved along the tappet channel axis;

(d) a pick component comprising a tooth;

(e) a lubrication system comprising:

(i) a lubricant pump:

(ii) a lubricant groove in the periphery of the tappet channel;

(iii) a lubricant supply passage which is in fluid communication with the lubricant pump and the lubricant groove;

(iv) a lubricant discharge vent;

(v) a lubricant discharge passage which is in fluid communication with the lubricant groove and the lubricant discharge vent;

wherein the hammer channel, hammer, means for applying force to the hammer, the tappet channel, the tappet, and the tooth are configured and arranged so that the application of force to the hammer will cause the tappet to move along the tappet channel axis, thereby applying a scaling force through the tooth.

5. The scaling apparatus of claim 4:

(a) wherein:

(i) the hammer is adapted to be moveable within the hammer channel between a first hammer position and a second hammer position;

(ii) the tappet is adapted to be moveable within the tappet channel between a first tappet position and a second tappet position;

(iii) the means for applying force to the hammer is adapted to move the hammer from the first hammer position to the second hammer position;

(iv) wherein the tappet channel, tappet, hammer channel and hammer are configured and arranged so that when the tappet is in the first tappet position, movement of the hammer from the first hammer position to the second hammer position will cause the tappet to move to the second tappet position;

(v) the hammer includes a piston component;

(vi) the hammer channel includes a front end having a front chamber and a rear end having a rear chamber, each of which chambers are in fluid communication with each other, which chambers are located on opposite sides of the piston component of the hammer;

(b) which includes:

(i) a hydraulic pump;

(ii) a front hydraulic flow passage that is in fluid communication with the hydraulic pump and the front chamber of the hammer channel;

(iii) a rear hydraulic flow passage that is in fluid communication with the hydraulic pump and the rear chamber of the hammer channel;

and wherein said piston component, front chamber, rear chamber, hydraulic pump, front hydraulic flow passage and rear hydraulic flow passage are configured and arranged so that:

(c) when the forces on the hammer due to fluid pressure in the rear chamber are greater than the forces on the hammer due to fluid pressure in the front chamber, the hammer will tend to move towards the second hammer position; and (d) when the forces on the hammer due to fluid pressure in the front chamber are greater than the forces on the hammer due to fluid pressure in the rear chamber, the hammer will tend to move towards the first hammer position.

6. The scaling apparatus of claim 4:

(a) wherein:

(i) the hammer is adapted to be moveable within the hammer channel between a first hammer position and a second hammer position;

(ii) the tappet is adapted to be moveable within the tappet channel between a first tappet position and a second tappet position;

(iii) the means for applying force to the hammer is adapted to move the hammer from the first hammer position to the second hammer position;

(iv) wherein the tappet channel, tappet, hammer channel and hammer are configured and arranged so that when the tappet is in the first tappet position, movement of the hammer from the first hammer position to the second hammer position will cause the tappet to move to the second tappet position;

(v) the hammer includes a front piston component and a rear piston component, which piston components are spaced apart from each other;

(vi) the hammer channel includes a front end, a rear end, a front chamber at the front end, a rear chamber at the rear end, and an intermediate chamber between the front chamber and the rear chamber, all of which chambers are in fluid communication with each other;

(b) which includes:

(i) a hydraulic pump;

(ii) a control valve that is in fluid communication with the hydraulic pump, the front chamber, the intermediate chamber and the rear chamber, said control valve being adapted to direct the flow of hydraulic fluid from the hydraulic pump;

(iii) a front hydraulic flow passage that is in fluid communication with the control valve and the front chamber of the hammer channel;

(iv) an intermediate hydraulic flow passage that is in fluid communication with the control valve and the intermediate chamber of the hammer channel;

(v) a rear hydraulic flow passage that is in fluid communication with the control valve and the rear chamber of the hammer channel;

and wherein said front piston component, rear piston component, front chamber, intermediate chamber, rear chamber, hydraulic pump, control valve, front hydraulic flow passage, intermediate hydraulic flow passage and rear hydraulic flow passage are configured and arranged so that:

(c) when the control valve directs the flow of hydraulic fluid from the pump so that the forces on the hammer due to fluid pressure in the rear chamber are greater than the forces on the hammer due to fluid pressure in the front chamber, the hammer will tend to move towards the second hammer position; and (d) when the control valve directs the flow of hydraulic fluid from the pump so that the forces on the hammer due to fluid pressure in the front chamber are greater than the forces on the hammer due to fluid pressure in the rear chamber, the hammer will tend to move towards the first hammer position.

7. The scaling apparatus of claim 6 wherein the hammer channel includes a cushion chamber behind the rear chamber, which cushion chamber is:

(a) adapted to cushion the hammer when it moves to the first hammer position;

(b) charged with a gas under pressure so as to exert a force on the hammer to move it towards the second hammer position.

8. A scaling apparatus comprising:

(a) a pick component which includes:

(i) a pick body comprising a first pivot having a pivot axis, and an impact surface;

(ii) a tooth mounted on the pick body;

(b) a hammer component which includes:

(i) a hammer housing;

(ii) a forward face;

(iii) a hammer channel within the hammer housing, said hammer channel having a hammer channel axis;

(iv) a second pivot mounted within the housing and adapted to pivotally engage the first pivot of the pick body;

(v) a hammer that is disposed within the hammer channel and adapted to be moved therein along the hammer channel axis;

(vi) a tappet channel having a tappet channel axis;

(vii) a tappet which is disposed within the tappet channel and adapted to be moved along the tappet channel axis;

(viii) means for applying force to the hammer so as to move the hammer along the hammer channel axis;

(c) a biasing mechanism for applying a biasing force between the hammer component and the pick body so as to urge the pick body away from the hammer component;

(d) control means for activating the means for applying force to the hammer only when an external force is applied to the pick body in opposition to the biasing force;

wherein the hammer channel, hammer, means for applying force to the hammer, the tappet channel, the tappet, and the tooth are configured and arranged so that the application of force to the hammer will cause the tappet to move along the tappet channel axis, thereby rotating the pick body about the pivot axis between a start position and an impact position.

9. The scaling apparatus of claim 8 in which the pick body has an upper surface which includes a rocker profile.

10. The scaling apparatus of claim 8 wherein the forward face of the hammer component is disposed within a guidance groove.

11. The scaling apparatus of claim 8 wherein the angle of rotation of the pick body about the pick axis between the start position and the impact position is less than or equal to about 5°.

12. The scaling apparatus of claim 8:

(a) wherein the hammer component includes:

(i) a forward face;

(ii) a tappet channel;

(iii) a hammer channel which is in communication with the tappet channel;

(b) which includes:

(i) a hammer which is mounted within the hammer channel and adapted to be moveable between a first hammer position and a second hammer position;

(ii) a tappet which is mounted within the tappet channel and adapted to be moveable between a first tappet position in which the tappet is entirely within the hammer housing and a second tappet position in which a portion of the tappet extends outwardly from the forward face to contact the impact surface of the pick body;

(iii) means for moving the hammer from the first hammer position to the second hammer position;

wherein the tappet channel, tappet, hammer channel and hammer are configured and arranged so that when the tappet is in the first tappet position, movement of the hammer from the first hammer position to the second hammer position will cause the tappet to move to the second tappet position; and wherein the first pivot, the second pivot, the forward face of the housing, and the impact surface of the pick body are arranged and configured so that the pick body pivots about the pivot axis between the start position and the impact position.

13. The scaling apparatus of claim 12 which includes a lubrication system comprising:

(a) a lubricant pump;

(b) a lubricant groove in the periphery of the tappet channel;

(c) a lubricant supply passage which is in fluid communication with the lubricant pump and the lubricant groove;

(d) a lubricant discharge vent;

(e) a lubricant discharge passage which is in fluid communication with the lubricant groove and the lubricant discharge vent.

14. The scaling apparatus of claim 12:

(a) wherein:

(i) the hammer includes a piston component;

(ii) the hammer channel includes a front end having a front chamber and a rear end having a rear chamber, each of which chambers are in fluid communication with each other, which chambers are located on opposite sides of the piston component of the hammer;

(b) which includes:

(i) a hydraulic pump;

(ii) a front hydraulic flow passage that is in fluid communication with the hydraulic pump and the front chamber of the hammer channel;

(iii) a rear hydraulic flow passage that is in fluid communication with the hydraulic pump and the rear chamber of the hammer channel;

and wherein said piston component, front chamber, rear chamber, hydraulic pump, front hydraulic flow passage and rear hydraulic flow passage are configured and arranged so that:

(c) when the forces on the hammer due to fluid pressure in the rear chamber are greater than the forces on the hammer due to fluid pressure in the front chamber, the hammer will tend to move towards the second hammer position; and (d) when the forces on the hammer due to fluid pressure in the front chamber are greater than the forces on the hammer due to fluid pressure in the rear chamber, the hammer will tend to move towards the first hammer position.

15. The scaling apparatus of claim 12:

(a) wherein:

(i) the hammer includes a front piston component and a rear piston component, which piston components are spaced apart from each other;

(ii) the hammer channel includes a front end, a rear end, a front chamber at the front end, a rear chamber at the rear end, and an intermediate chamber between the front chamber and the rear chamber, all of which chambers are in fluid communication with each other;

(b) which includes:

(i) a hydraulic pump;

(ii) a control valve that is in fluid communication with the hydraulic pump, the front chamber, the intermediate chamber and the rear chamber, said control valve being adapted to direct the flow of hydraulic fluid from the hydraulic pump;

(iii) a front hydraulic flow passage that is in fluid communication with the control valve and the front chamber of the hammer channel;

(iv) an intermediate hydraulic flow passage that is in fluid communication with the control valve and the intermediate chamber of the hammer channel;

(v) a rear hydraulic flow passage that is in fluid communication with the control valve and the rear chamber of the hammer channel;

and wherein said front piston component, rear piston component, front chamber, intermediate chamber, rear chamber, hydraulic pump, control valve, front hydraulic flow passage, intermediate hydraulic flow passage and rear hydraulic flow passage are configured and arranged so that:

(c) when the control valve directs the flow of hydraulic fluid from the pump so that the forces on the hammer due to fluid pressure in the rear chamber are greater than the forces on the hammer due to fluid pressure in the front chamber, the hammer will tend to move towards the second hammer position; and (d) when the control valve directs the flow of hydraulic fluid from the pump so that forces on the hammer due to fluid pressure in the front chamber are greater than the forces on the hammer due to fluid pressure in the rear chamber, the hammer will tend to move towards the first hammer position.

16. The scaling apparatus of claim 12 wherein the hammer channel includes:

(a) a front end;

(b) a rear end having a cushion chamber that is adapted to cushion the hammer when it moves to the first hammer position.

17. The scaling apparatus of claim 16 wherein the cushion chamber is charged with a gas under pressure so as to exert a force on the hammer to move it towards the second hammer position.

* * * * *